US005280662A

United States Patent [19]

Van Fossen

[11] Patent Number: 5,280,662

[45] Date of Patent: Jan. 25, 1994

[54] MOBILE TUNNEL SURFACE CLEANING MACHINE

[75] Inventor: Dennis K. Van Fossen, Richmond, Ohio

[73] Assignee: Diamond Specialized, Inc., Steubenville, Ohio

[21] Appl. No.: 845,230

[22] Filed: Mar. 3, 1992

[51] Int. Cl.[5] ..... A47L 11/38; A46B 13/04; E01H 1/02

[52] U.S. Cl. ..... 15/50.1; 15/49.1; 15/53.1; 15/180

[58] Field of Search ..... 15/21.1, 88.4, 50.1, 15/49.1, 53.1, DIG. 2, 180

[56] References Cited

U.S. PATENT DOCUMENTS

| | | | |
|---|---|---|---|
| 1,901,647 | 3/1933 | Howald et al. | 15/50.1 |
| 3,099,852 | 8/1963 | Grant | 15/88.4 |
| 3,196,472 | 7/1965 | Ventrella | 15/50.1 |
| 3,439,372 | 4/1969 | Collier | 15/50.1 |
| 3,460,177 | 8/1969 | Rhinehart et al. | 15/50.1 |
| 3,680,164 | 8/1972 | Thornton-Trump | 15/88.4 |
| 3,748,680 | 7/1973 | Griffin | 15/88.4 |
| 3,922,745 | 12/1975 | Lehman | 15/21.1 |

FOREIGN PATENT DOCUMENTS

| | | | |
|---|---|---|---|
| 0383379 | 8/1990 | European Pat. Off. | 15/50.1 |

*Primary Examiner*—Edward L. Roberts
*Attorney, Agent, or Firm*—Clifford A. Poff

[57] ABSTRACT

There is disclosed a highway tunnel surface cleaning vehicle having an adjustable boom at generally the center of the vehicle that extends over the cab and which carries a brush assembly made up of an array of linearly aligned brush units, the units rotationally supporting a number of driven brushes being articulated into a number of different positions by separate power devices to allow positioning of the brush units, and particularly their brushes, to accommodate the changing conditions of the surface to be cleaned. Also disclosed is a support structure for the brushes that allow selected brushes to be held out of operation, and a construction that allows the brushes to be flexibly supported and the cleaning liquid to be applied in close proximity to the brushing zone and prevented from escaping from the zone.

19 Claims, 5 Drawing Sheets

MOBILE TUNNEL SURFACE CLEANING MACHINE

BACKGROUND OF THE INVENTION

This invention relates to a mobile tunnel surface cleaning machine of the type that may be used in performing maintenance cleaning of vehicle highway tunnels. In order to reduce the cost, time, concern for safety and upgrade in quality and efficiency in periodically manually cleaning the sides and ceiling surfaces of highway tunnels, for example, tile surfaces, it has become the increased practice to employ truck like vehicles having some form of a manipulative brush assembly for performing the cleaning operations.

In an earlier form of a mechanical system, attempts were made to use a brush assembly of the type commonly utilized in automatic drive through car washers, which relied, to a great extent, on the centrifugal force of a rotating brush. This system was found to be ineffective due to the fact that the brush bristles are positioned only by centrifugal force and was substantially ineffective to produce a scrubbing force when the brush was forced against the tunnel surface to be cleaned, which it turn created an unbalanced rotational condition for the brush.

Many of these vehicles are provided with brush assemblies mounted on the back of the vehicles, the vehicles in any event being usually manned by two persons, one who drives the vehicle, the other who operates the brush assembly. In this way the vehicle is driven very slowly along one of the lanes of the highway in a manner that the brush assembly is brought into contact with the tunnel surface to be cleaned with the aid of sprayed hot water, liquid cleaner or detergent and a rinse. While such machines represent a significant improvement over the manual operations, they have not met all of the above objectives.

One of the limitations of present day mechanical designs is the inability to arrange the brush assembly to apply a constant high and effective brush pressure and in doing so to avoid the reaction force taken by the truck preventing the obtaining of the desired brushing action. In past designs this reaction force has been found to push the truck out of its proper traveling path or tend to tilt the truck, thereby causing a drop in the brush pressure and development of an uneven brush pressure condition. In other cases, because the brush assembly is mounted at the rear of the truck, where most of its weight is located and the brush assembly operates adjacent the rear of the truck, when pressure is applied by the brush assembly the reaction force on the truck tends to tilt the truck about its rear wheels, thereby creating a condition where the brush pressure is lowered and it is impossible to control brush pressure.

Another limitation of present day mechanical designs is their inability to create a condition where the water used in the cleaning is maintained at a desired heated temperature when applied to the surface to be cleaned. This leads to a second problem of having to use high concentrations and high volumes of cleaning acid used to clean hard to clean areas of the tunnel, which use creates environmental clean up concerns.

In present day machines even when hot water is used to affect cleaning, the sprays are either arranged a considerable distance from the surface to be cleaned so that the heat of the water is lost by the time it contacts the surface. In addition there is no way to contain or enclose the water during the brushing action to prevent loss of water heat by radiation and escapement or effectively using the friction heat of the brushing action to maintain the water at a desired temperature. Because of this the use of acid becomes necessary and with it the environmental associated clean up problems.

As to the concern of upgrading the quality and efficiency of the cleaning operation, one of the principal problem that must be overcome in present cleaning machines is that presented by the construction characteristics of the tunnels, for example, the various contours of their surfaces, the condition of the tile or other surface material, and the presence of protuberance and recesses in the surfaces in the form of lights, conduits, radio antennas, etc.

The common practice of having the brush assembly operate out of and adjacent to the back of the truck creates the additional problem of the driver and brush assembly operator not being positioned to sit next to each other and therefore not having a common view of the same working area at the same time and which does not permit the workmen to see the working area immediately after the area has been cleaned, instead they see the area only after the truck and brush assembly has past beyond the area. At this point it is to late to make any corrections in the cleaning operation.

SUMMARY OF THE INVENTION

The present invention has for its object providing a mobile tunnel surface cleaning machine that will overcome each of the above noted problems, disadvantages and limitations.

More particularly, the present invention has for one of its objects providing a mobile tunnel surface cleaning machine characterized by improved quality and efficiency in performing the cleaning at a substantial saving in cost and time. This is accomplished by providing a brush assembly made up of an array of in-line brush units carried by a support structure operative from the front of the vehicle, the support structure being capable of being quickly manipulated in various operating planes and/or position attitudes so as to position the array as a unit and one or more brush units separately, to accommodate the various above noted conditions of a surface to be cleaned or otherwise treated.

The support structure for the brush assembly may take the general form of a truck mounted crane supported boom, the boom having a telescoping section which supports the brush assembly support beam by means of a sub-support means, arranged at the heavy loaded rear of the truck with the brush assembly arranged to extend from the front of the truck in a manner to exert a high and constant brush pressure. The beam and sub-support means are constructed to move by adjustable means and by their construction in at least six different operating planes or positions to place and maintain each brush unit in the most favorable force contacting position as dictated by the conditions of the surface to be cleaned or otherwise treated.

The brush units each comprise a novel construction of alternating extending operative and retracted inoperative brushes, constructed and arranged in such a manner that the retracted brushes serve to give stability to the operative ones and allow the inoperative ones to refurbish themselves in readiness to be substituted for the operative brushes. The brush units are adapted to be rotated in opposite clock-wise directions.

Another feature of the invention is to provide for each brush unit a support structure, for both driving and supporting each brush unit in a manner that the brush units are given a predetermined degree of flexibility allowing them to deflect when they experience uneven pressure from the surface to be cleaned or treated.

A still additional feature of the invention is to provide a novel manner of applying the liquid used in the cleaning operation, for example, water, in which the water is applied immediately in the zone of the brushes in a manner that it is prevented from freely escaping from the cleaning zone, and in which the frictional heat generated by the contact of the brushes under high pressure with the surface to be cleaned will be used to either heat the water, if applied in a cold condition, or to retain the heat of the water if applied in a heated condition.

BRIEF DESCRIPTION OF THE DRAWINGS

The above objects and features of the present invention will be better understood when the following description of the preferred embodiment thereof is read along with the accompanying drawings, of which.

DETAIL DESCRIPTION OF THE INVENTION

Figure 1A:
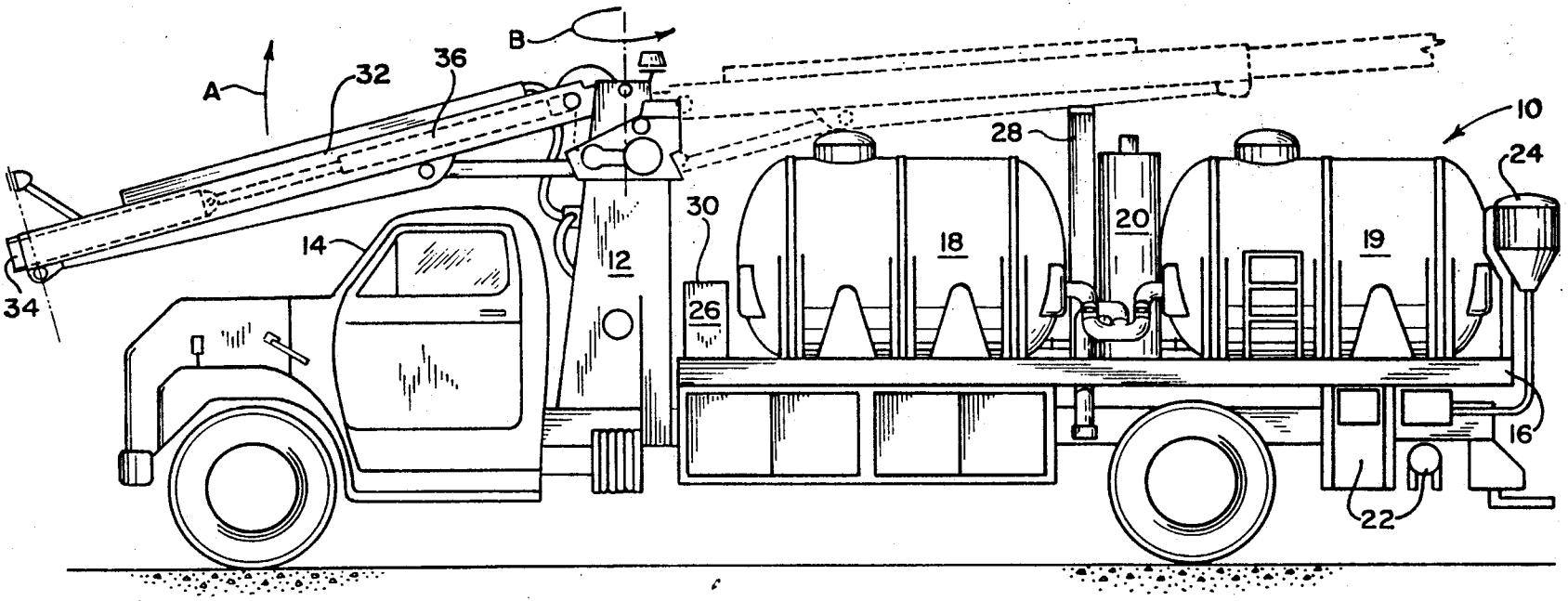
FIG. 1A is an elevational view of a vehicle incorporating the present invention illustrating, in part, the operative relationship of the support boom for the brush assembly relative to the cab of the vehicle.
Figure 1B:
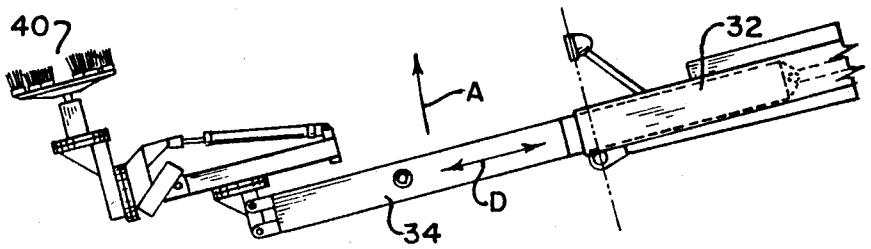
FIG. 1B is an elevational view of the front end of the support boom, partly shown in FIG. 1A, and of the brush assembly.

With reference to FIGS. 1A and 1B there is shown a self sustaining vehicle 10 in the form of a more or less standard flat bed truck which has been adapted to accommodate the support for the brush assembly and the auxiliary equipment necessary to accomplish the tunnel cleaning operation. The support for the brush assembly takes the form of a well known truck mounted crane 12 having its base mounted on the bed of the truck between the cab 14 and the elongated bed portion 16. The cab end includes the motor and front wheels of the truck. On the bed portion is situated the necessary and usual auxiliary equipment for the cleaning operation, such as hot and rinse water containers 18 and 19, water heater 20, pumps 22, cleaner ingredients or compounds container 24, and a dual control unit 26 for the truck mounted crane 12 and the other brush assembly positioning means.

The bed portion 16 also has an upright pedestal 28 employed to support the support boom and brush assembly when the truck is in transit, which position is indicated in outline form in FIG. 1A. For this purpose the truck mounted crane 12 is provided with a drive means 30 for rotating the support boom from the hard line position to the out line position of FIG. 1A, in addition for raising, lowering and moving transversely the boom in the usual manner, and in rotating the boom clockwise and counter clockwise about a vertical axis, which movements are indicated by arrows A and B in FIGS. 1A and 1B.

Figure 3:
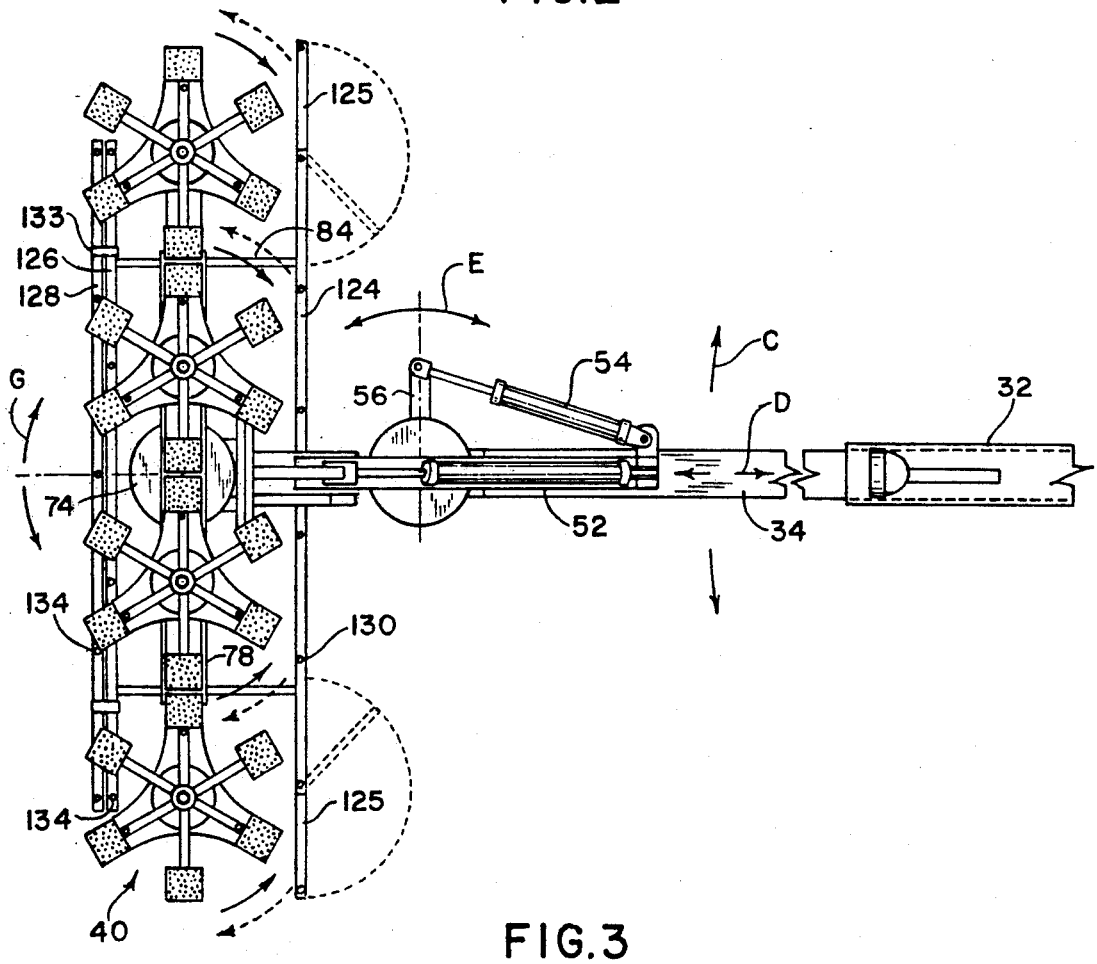
FIG. 3 is a plan view of the support boom and brush assembly shown in FIG. 2.

The truck mounted crane 12 has a support boom 32, which is pivotally mounted on and supported by the stationary part of the truck mounted crane in a usual manner, giving the boom left to right and up and down movements A and C, both movements being sufficient for the ranges involved, movement C being indicated by arrow C in FIG. 3. The boom has a usual telescoping outer end 34, its movement being shown in FIG. 1B by the arrow D, to which the rod end of a double acting hydraulic piston cylinder assembly 36 is connected, the cylinder being internally mounted in the adjacent end of the boom 32 as shown in FIG. 1A. As shown in FIG. 1B, to the outer end of the telescoping end 34 a brush assembly is mounted, indicated generally at 40.

Figure 2:
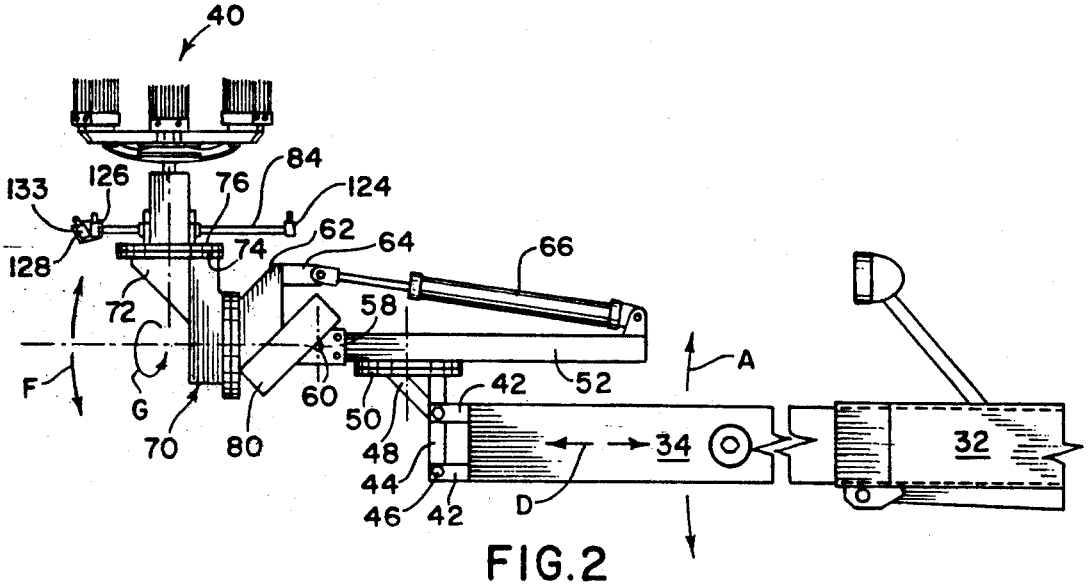
FIG. 2 is an enlarged elevational view of the brush assembly shown in FIG. 1B.
Figure 4:
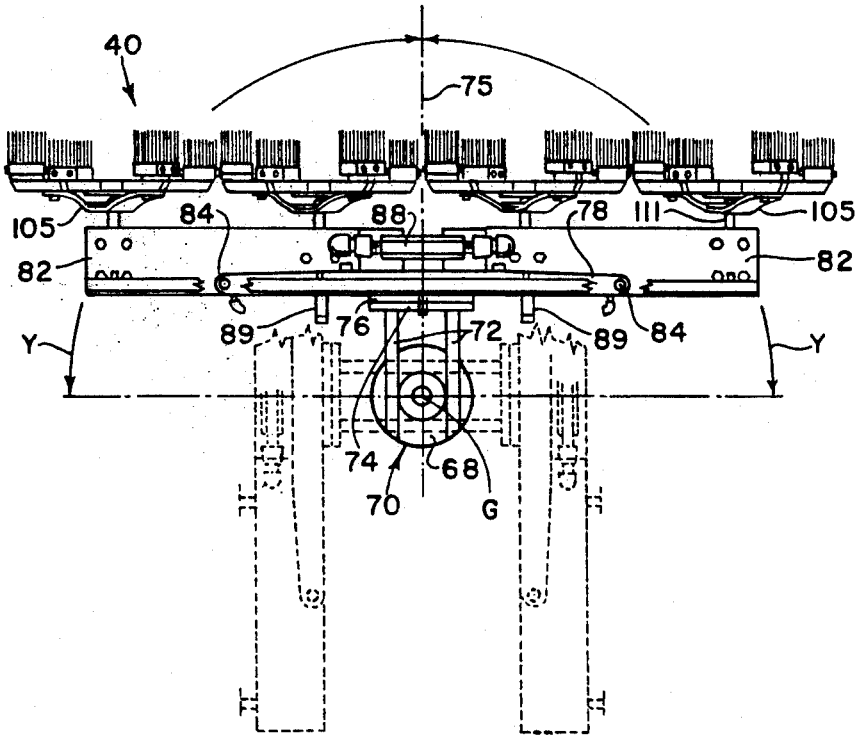
FIG. 4 is a end elevational view of the brush assembly shown in FIG. 3, showing the assembly in a vertical position relative to the roadway.

With reference to FIGS. 2, 3, and 4, which relate particularly to the brush assembly 40, as noted above, the assembly and the brush units thereof are provided with six different fundamental coordinated and cooperative movements or attitude adjustments, each such movement being adjustable through a predetermined closely controlled range. With reference first to what may be referred to as a reverse left to right movement or attitude adjustment, it will be noted in FIGS. 2 and 3 that at the front of the telescoping end 34 opposed upper and lower in-line pairs of ears 42 are provided. In the space between the pairs of ears a bracket 44 is secured by two bolts 46, the bracket having, as viewed in FIG. 2, an upwardly extending arm 48 that is connected to and which carries the stationary part of a pivot assembly 50.

The upper most or movable part of the assembly 50 is part of an elongated beam 52 that extends in one extreme position generally parallel to the boom 32, and in another at a right angle thereto, and which is adapted to be rotated from left to right and right to left, as one views FIG. 3. To the one side of the beam 52 there is pivotally mounted a double acting hydraulic piston cylinder assembly 54, its rod end being connected to an arm 56 extending generally horizontally from the stationary part of the pivot assembly 50, as one views FIG. 3, whereas its cylinder end is pivotally connected to the movable beam 52. This movement, indicated by arrows E, is designed to be at least 90°.

With reference now to the second movement of the brush assembly 40, which may be referred to as a reverse bottom to top movement or attitude adjustment, as one views FIG. 2, to the outer end of the beam 52 two parallelly extending support plates 58 are rotatably supported by a stationary support pin 60 that passes through the outer end of the beam and is carried by the beam. The plates 58 are an integral part of a housing 62 having an arm 64 to which the rod end of a double acting hydraulic piston cylinder assembly 66 is attached, the cylinder end being pivotally connected to and carried by the beam 52, as best shown in FIGS. 2 and 3. This movement, indicated by arrow F, in FIG. 2 is designed to be at least 90°.

The third movement or attitude adjustment of the brush assembly 40 is referred to as a reverse clock-wise counter clockwise movement, as one views FIG. 2 and as viewed from the cab 14 of the truck 10. The bottom of the housing 62 is formed into the stationary part of a pivot assembly 68, the pivotal or movable part being part of a second housing 70 arranged on the side opposite the arm 64 of the housing 62, as one views FIG. 2.

The housing 70 on the outside of its movable part is provided with two parallelly extending arms 72 which terminate into and are an integral part of perpendicularly arranged circular member 74, shown best in FIG. 4, which is welded to two parallely arranged spaced apart bars 78, that extend a considerable distance equally from each side of the housing 70. Rotatably associated with the circular member 74 is a similar cooperative circular member 76 which is constructed to rotate about a pivot 75 a limited degree relative to the member 74. The bars 78 with the central housing 70 form an I shaped frame, as viewed from the outer side of the brush assembly. The controlled rotational movement of the housing 70 is accomplished through the agency of a combined worm-gear set and hydraulic motor or actuator 80. This movement, indicated be arrow G in FIGS. 2 and 4, is designed to be at least 90°. FIG. 4 shows in phantom the bars 78 rotated in two different parallel vertical positions relative to the pivot assembly 68.

Figure 8:
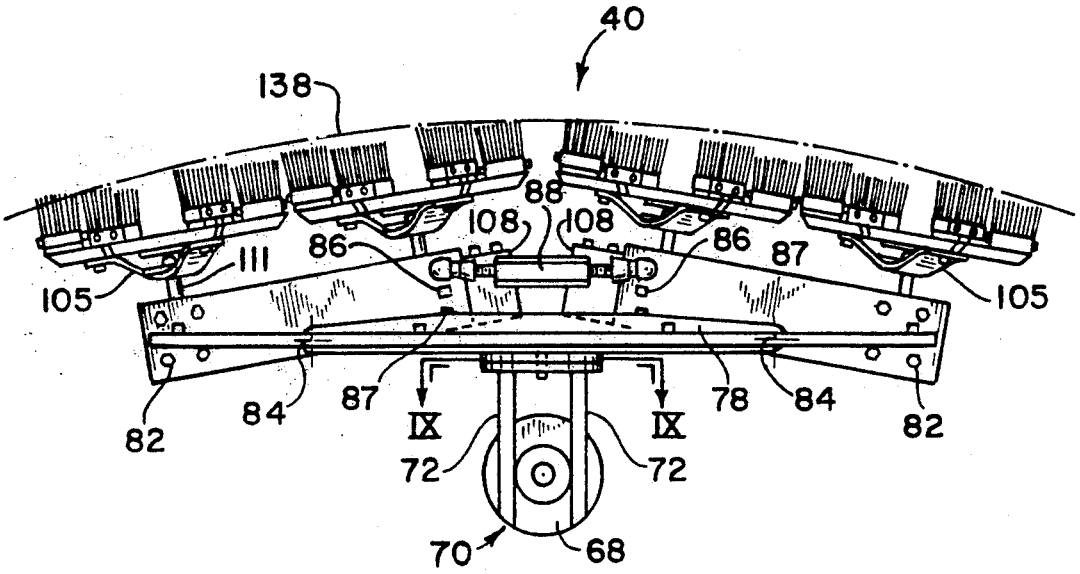
FIG. 8 is a view similar to FIG. 4, but showing the brush assembly in a tilted position.
Figure 9:
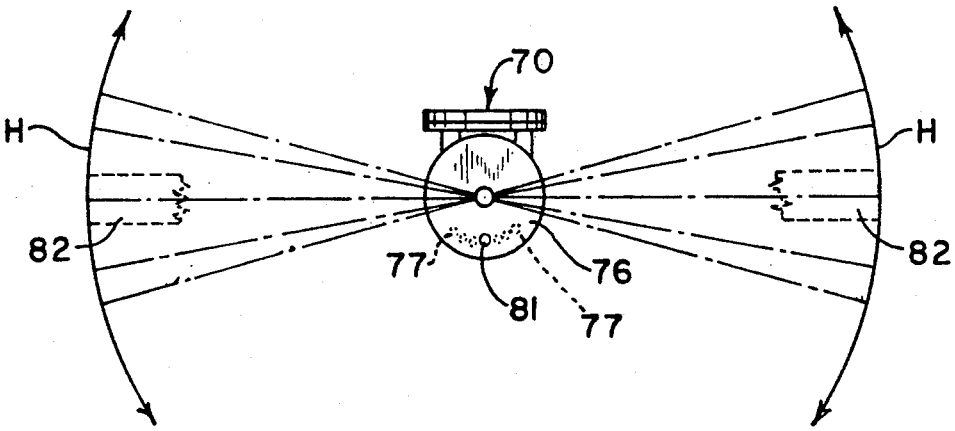
FIG. 9 is a sectional view taken or lines IX—IX of FIG. 8.

The movement of the member 76 may be referred to as the fourth movement or attitude adjustment and is accomplished as shown in FIG. 8 by providing a series of matching circular spaced holes 77, in the members 74 and 76 into which a locking pin 81 may be inserted when the member 76 is rotated to a desired position in which two matching holes 77 line up. This adjustment, indicated by arrows H in FIG. 8, is used when a finer positioning of the brush assembly is needed then what can be obtained by the adjustment E effected by the piston cylinder assembly 54.

At this point it will be noted that all of the control for the piston cylinder assemblies 36, 54, 66 and the hydraulic actuator 80 are located in the cab of the truck, a part of the controls located out of the truck being identified only at 26 in FIG. 1A, which allow the operator of the brush assembly to quickly and accurately affect movements of the several pivots through their associated power means. The power means, include hydraulic pressure pumps, indicated only generally at 22 in FIG. 1A, for each cylinder assembly and motor are capable of operating the cylinder assemblies and hydraulic motor to bring about a position control of the telescoping end 34, beam 52 and housing 70.

As to the boom 32, it has it own constant pressure pump and control indicated in FIG. 1A at 30, that allow the boom to be initially positioned and also to be urged thereafter by a controlled pressure against the surface to be cleaned during the actual cleaning operation. The control of the position and positive operating pressure is enhanced by the fact that the controls for the cylinder assemblies and actuator can be located in the cab of the truck next to the driver. This allows the driver and brush assembly operator to be in close communication and enables both to be in a position immediately behind the area cleaned. This permits, for example, when cleaning the sides of a tunnel for the driver and operator to view the cleaning action and if required to make a corrective adjustments, either or both by moving the truck closer to or away from the wall and/or making an adjustment of the brush assembly.

Equally important is the fact that by having the brush assembly 40 mounted as disclosed, the most advantageous use of the weight of the truck can be utilized to allow full use of the brush pressure generated by the boom. The disclosed design eliminates or substantially reduces any reaction forces that would tend to move the truck out of the proper path of travel and tilt the truck about its longitudinal axis or about its rear wheels. Thus, a very stable operating condition is achieved for both assuring a high effective brush pressure and ease of control of the path of the truck.

Figure 7:
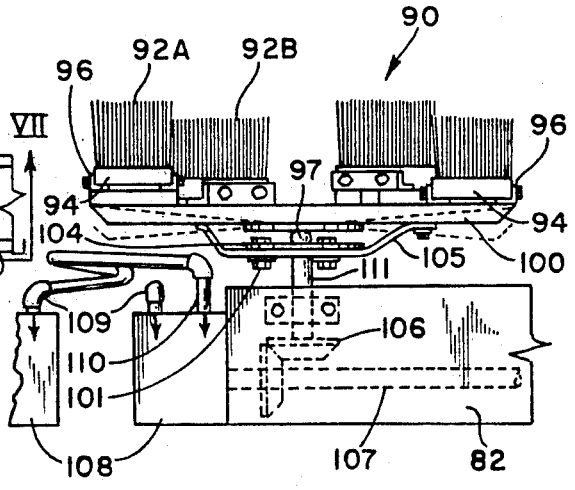
FIG. 7 is a sectional view taken on lines VII—VII of FIG. 5 showing alternate brushes in extended operative and retracted inoperative positions.

As to the fifth movement or attitude adjustment of the brush assembly 40, which may be referred to as a tilting movement or attitude positioning as one views FIGS. 4 and 7, it will be noted that between the parallel bars 78 there is pivotally mounted two box like frames 82 on either side of the housing 70, the frames being rotationally mounted on similar transverse parallelly arranged shafts 84, best shown in FIG. 4. On the adjacent inner ends of the frames 82 on either longitudinal side stop ears 86 are provided which have lower flat surfaces that engage with rubber cushions 87 secured to adjacent flat surfaces formed on the bars 78, two of which are shown in FIG. 4, that limit the extent of downward movement of the frames. A similar stop assembly is provided to limit the upward movement of the frames indicated generally at 89 in FIG. 4.

The pivot points formed by shafts 84 of the frames 82 are spaced outwardly of the housing 70 at approximately the longitudinal centers of the frames and as such the frames are adapted to be tilted to cause the inner ends of the frames to move toward and away from the bars 78, and wherein one frame can be tilted relative to the other or both may be tilted to the level and tilted positions shown in FIGS. 4 and 7, respectively. This tilting movement is accomplished by a double ended turnbuckle unit 88, the opposite ends of the unit 88 being pivotally connected to the inner adjacent ends of the frames 82, the oppositely threaded ends allowing separate adjustment of one frame relative the other frame. While this adjustment in the construction shown is to be made by a hand tool, if desired, a power means may be employed that can be operated remotely.

Figure 5:
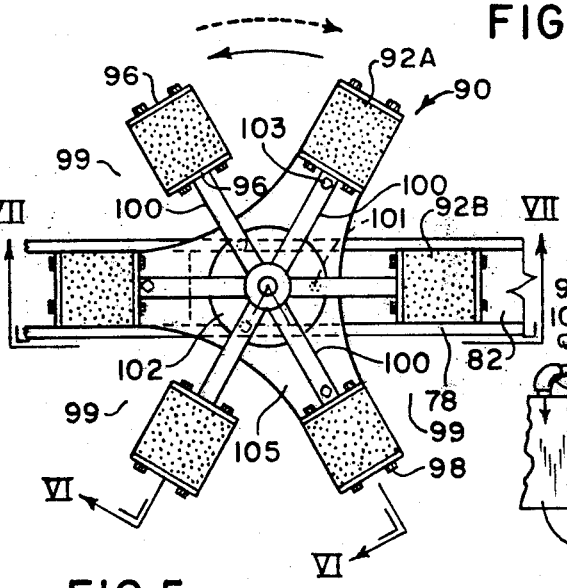
FIG. 5 is an enlarged plan view of one of the brush units that make up a brush assembly, showing alternate brushes in extended operative and retracted inoperative positions.
Figure 6:
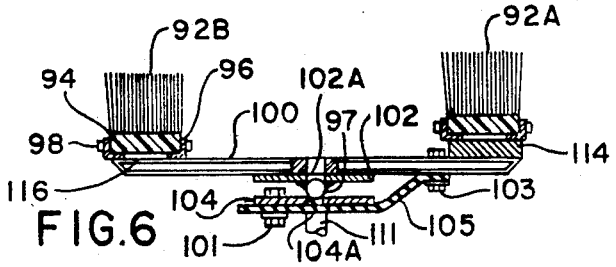
FIG. 6 is a sectional view taken on lines VI—VI of FIG. 5 showing alternate brushes in extended operative and retracted inoperative positions.

With reference to the brush units which are best shown in FIGS. 5, 6 and 7, on each frame 82 there is mounted two in-line brush units 90, each unit comprising six spaced apart brushes 92, sometimes indicated as 92A and 92B. While the individual brushes are separated by open spaces, in use these spaces are allowed for by tilting the entire brush assembly to create an overlapping brush cleaning relationship in the direction of travel of the truck. The plastic base retainers 94, are square shaped and adapted to fit into opposed L shaped angle members 96, between which the retainers slide and are secured by bolts 98.

The height of the brush in their unused and fully used conditions may be 4½ and 2-2½ inches long, respectively. The bristles of the brushes 92, in the preferred form, are oval shaped in cross-section, in which the brushes are formed of alternating rows of bristles of difference diameter bristles, one alternating row of bristle having a row of substantially stronger, stiffer bristles than the adjacent row of bristles, which are made to have a substantially greater density, i.e., thicker than the stronger ones. The stiffness and density is obtained from the bristle material used and their dimensions, the material preferably being of a poly-olefin. The greater density bristles are employed to increase the abrasion action and to increase the ability to retain the cleaning liquid or solution, whereas the stiffer bristles are employed in combination with the greater density ones to produce the necessary stiffness to the greater density bristles with which they are closely associated. In this way an improved agitation cleaning action is achieved. To further improve such action, the bristles instead of being formed as substantially straight members are formed to have a certain waviness in their lengthwise direction, i.e., multiple waves of small amplitude along the bristle length. The above noted combination of characterizes of the brush units and their bristles provide for a greatly improved cleaning and/or treating action.

The angle members 96 are welded to and supported by rigid spoke formed bars 100, which are joined together at their inner ends to a support disc 102. A similar disc 104 is provided below the disc 102 which carries a three pronged flexible rubber driving member 105 arranged below and secured by bolts 101 to the disc 104 and the inner ends of the three pronged member 105, as best seen in FIGS. 5 and 6, where in FIG. 6 it is shown that the shape of the member 105 is such that three open areas 99 are provided between three of the brushes 92. Between the two disc 102 and 104 is arranged a spherical pivot harden steel alloy ball 97. As shown best in FIG. 6, the upper portion of the ball sets in a central opening 102*a* provided in the disc 102 to which it is welded and also is seated in a similar opening 104*a* provided in the disc 104 and acts as a centering and tilting control bearing for each brush unit. The flexible driving member is secured to the outer ends of the bars 100 by bolts 103 and may be made of a rubber impregnated cord material, similar to the material used for industrial type conveyor belts.

The use of the three prong flexible rubber driving member 105, in combination with the pivot ball 97, allows the brushes of each brush unit a certain amount of predetermined flexibility as the brushes react to a change in contour, resistance or other conditions of the tunnel surface to be cleaned under the constant pressure urging the brushes against the surface, which flexibility may be referred to as the sixth movement or attitude adjustment of the brush assembly and is shown in dash lines on FIG. 7. The disc 104 for each brush unit 90 is supported and rotated by a shaft 111 provided for each brush unit, the lower end of the shafts pass into the associated frames 82 where they are connected to an individual gear sets and a common drive shaft for each frame, one set of these elements being shown in FIG. 7 and identified by reference numbers 106 and 107, respectively.

The drive shaft 107 of each frame 82 is driven by separate hydraulic motors 108, each mounted at the inner end of their associated frames 82. The motors 108 are arranged in series, each having an input hose 109 and an output hose 110. The reversing of the direction of rotation of the brushes is accomplished by simply reversing the direction of flow of the fluid in hoses 109 and 110.

The use of separate drive units for each frame 82 allow the frames to be tilted, as noted above, without disturbing the ability to continue to drive the brush units 90 of each frame. It is also a feature of the invention to be able to selectively rotate the brush units first in one common direction and then in an opposite common direction to provide for improved wear of the brushes. This is accomplished by simply reversing the motors 108.

In operation, only alternate brushes 92 are used to clean, the other brushes of each brush unit 90 being maintained below the operative plane of the operating brushes. With reference to FIGS. 6 and 7, it will be seen that brushes 92A are positioned above brushes 92B by a distance of approximately 1 inch. The raised position is obtained by providing for alternate spoke like bars 100 increased height support members 114, formed integrally with the bars, as compared with the thickness or height of the outer ends of the bars at 116 for the other alternate brushes. This allows the brushes 92A carried by the members 114 to project above the brushes 92B, as shown in FIGS. 6 and 7. Instead of the support members 114, the raised brush condition can be obtained by employing filler members inserted between the member 96 and the brushes.

A number of advantages flow from this design, one it has been found to give improved cleaning action, two, the brushes kept out of action during the rotation of the brush units have been found to refurbish themselves, in which the fibers of the brushes straighten out themselves from the laid over condition assumed during cleaning. The third advantage has reference to the fact that the recessed brushes give stability to the raised brushes and keep their support bases from being skewed or tilted when the brush units, for example, pass over a recess in the surface being cleaned. Once the brushes 92A in the operative position are worn they may be removed from the members 114 and the other recessed brushes 92B mounted in their places, after which the worn brushes 92A are reinserted in the recessed positions.

The several liquids used in the cleaning operation are supplied by three spray headers 124, 126 and 128 carried by the support shafts for the frames 82 in close proximity to the brush units, the headers being best shown in FIGS. 2 and 3. The header 124 is mounted on the side of the frames 82 towards the truck 10, the support being created by the shafts 84, in which the header 124 is secured to the ends of the shafts at a spaced distance from the frames sufficient to be below and outside the circular path of travel of the brushes 92. The header extends generally parallel to both frames 82 for the full lengths thereof and have eight equally spaced spray nozzles 130 that point towards the brushes, as one views FIG. 5. As shown in phantom in FIG. 3, the two opposite ends 125 of the header 124 may be pivoted rearwardly which may be desirable in certain cleaning conditions.

The headers 126 and 128 are mounted on the side of the frames 82 opposite the truck, in which the header 126, as best shown in FIGS. 2 and 3, is connected to the adjacent ends of short extensions of the shafts 84. The header 128 is connected to and carried by the header 126 by several spaced clips 133, shown only in FIG. 3. The headers 126 and 128 are somewhat shorter in length than the header 124 and are arranged below and inside the circular path of travel of the brushes 92 and within the openings 99, the header 126 having four and the header 128 five equally spaced spray nozzles 134 pointed towards the brushes. The header 124 receives pressurized hot or cold rinse water from a flexible hose, not shown, which feeds the water to the inside of the shafts 84, which are provided with internal passageways for this purpose. The header 126 may receive pressurized hot or cold water from a flexible hose, not shown, and the header 128 may receive by a flexible hose, not shown, an abrasive or cleaning slurry, such as a pumice stone compound, acid, detergent etc. in a water mixture, all of which are well known ingredients as cleaning agents for the purpose in question.

It is an important feature of the invention to improve how both the fluid is applied from the headers 126 and 128 and how the fluid is maintained in a heated condition to increase the effectiveness of the cleaning action and in eliminating or reducing the amount of acid used to clean and to increase its effectiveness when used. These objectives are accomplished by arranging the headers close to the brushes and introducing the fluid directly into the zone of cleaning defined by the circular path of travel of the brushes.

In this way the possibility of the heat in the liquid being lost is reduced. The fluids are sprayed between the openings 99 formed by the driving member 105, in which the member provides a partial enclosure preventing the two fluids of headers 126 and 128 from leaving the cleaning zone. This construction is important not only in keeping the liquid in the cleaning zone for a longer period of time but equally important is the fact that the member 105 helps capture and retain the heat generated by the frictional contact of the brushes with the surface being cleaned, which heat is transferred to the liquid in the enclosure. The frictional heat value is increased under the pressure afforded by the weight distribution in the manner of supporting the brush assembly described above and may be considerable. Thus, in the hard to clean areas of the tunnels their may be no need to use acid or if used of a much less quantity, thereby eliminating or substantially reducing environmental clean up concerns.

Figure 10A:
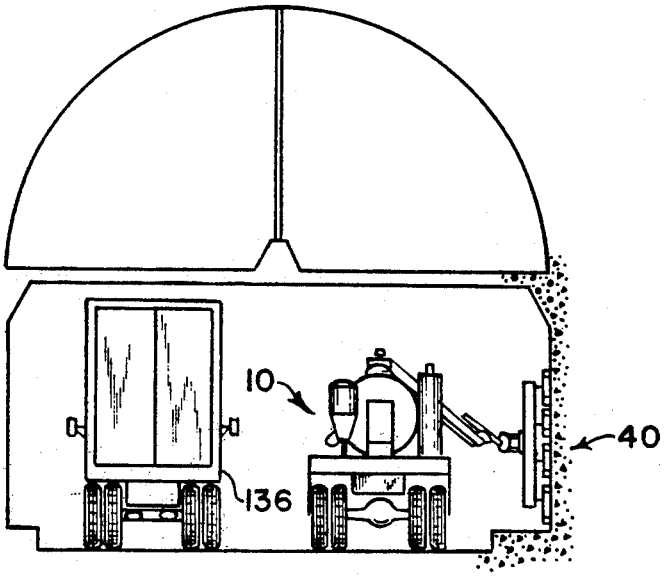
FIGS. 10A, B, C and D are four schematic views of the brush assembly illustrating several of the many and various operating planes and/or attitude adjustments that the assembly is capable of assuming.
Figure 10B:
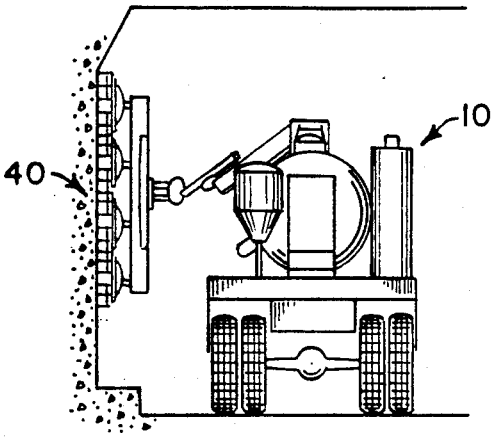
Figure 10C:
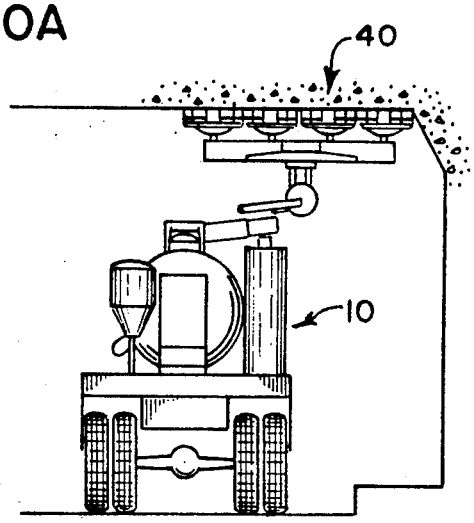
Figure 10D:
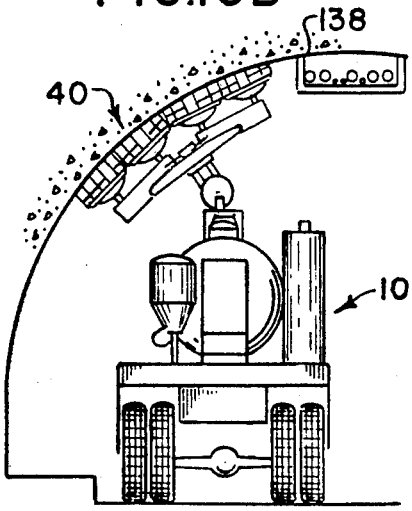

In FIGS. 10A, B, C and D there is illustrated four of the many operating positions of the brush assembly 40 in relation to the truck 10 and the ceiling and wall of a tunnel. In addition, in FIG. 10A there is shown a vehicle 136 in the adjacent lane of the highway while the truck 10 is operating in the other lane in the same direction of travel as the vehicle 136. In FIG. 10D, in addition to the adjustments of the boom 32, beam 34, housings 62 and 72 and support 76, the frames 82 are shown in tilted positions to accommodate the curve 138 of the ceiling of the tunnel. In all of the positions shown in FIGS. 10A, B, C and D the advantages of the improved weight distribution of the brush assembly may be seen, and an appreciation obtained of the ability to apply a high uniformly controlled brush pressure, and that such forces will not create a condition that will make it difficult to maintain the truck in the desired path of travel relative to the surface to be cleaned. When these Figures are considered in combination with FIGS. 1A and 1B, the aforesaid stated advantages of placing the brush assembly 40 in the front of the truck 10 will also be appreciated.

In briefly describing the operation of the above described mobile tunnel surface cleaning machine, let it be assumed that a section of the wall of a tunnel is to be cleaned and that the truck 10 has been made ready to start the operation. The truck will be positioned in the proper lane of the highway and in the direction of the traffic with the driver and brush assembly operator in the cab of the truck next to each other facing the area to be cleaned.

The brush assembly operator will position the boom 32 and its telescoping end 34 to place the brush assembly 40 at the proper elevation across from the area to be cleaned by displacement and rotation of the housing 62 by operation of the hydraulic actuator 80, and the piston cylinder assembly 66, if necessary. The frames thus will be in one of the phantom positions shown in FIG. 4. The brush assembly will then be rotated, if necessary, about pivot assembly 50 and pivot assembly 68 by the piston cylinder assembly 54 and actuator 80 to bring the brush assembly 40 towards the wall and to position the brush units 90 in a vertical attitude relative to the wall. If necessary, the tilt of the frames 82 may be also adjusted to suit 15 the contour of the wall by adjustment of the turnbuckle unit 88, keeping in mind that the brushes 92 have built in their supports a certain amount of flexibility by reason of the rubber driving member 105. Also, if desired, a further adjustment of the position of the brush assembly can be made by positioning of the member 76. The position of the brush assembly will be skewed as one views FIG. 4 to cause the brushes 92 to assume an overlapping condition, thereby to assure that all the area in the field to be cleaned will be contacted by the brushes 92. Also, as noted, only alternate brushes 92A and 92B will be arranged in the extended operative positions, the other brushes will be recessed. Once the desired several positions have been set, the fluids in the piston cylinder assemblies and actuator, including the cylinder 36 for the telescoping end 34 are set to blocking or holding positions, including initially the driving means for the boom 32.

The cleaning and rinse fluids are than turned on and the truck is slowly advanced through the tunnel, at the same time, if not before, the driving means for the boom 32 is operated to change from the holding position to cause the boom to exert a predetermined positive pressure resulting in a positive pressure being applied by the boom 32 to continually urge the brushes 114 against the wall. As the truck 10 is advanced, the driver and brush operator are given the opportunity to immediately view the area just cleaned and hence the opportunity to quickly affect any corrective measures should a condition be discovered that requires such action. As the truck continues on its path of travel, the several adjustments provided for the brush unit 90 will allow quick adjustment of the brushes 92 to be made to accommodate any and all of the tunnel conditions noted above, resulting in a substantially saving in time and expense and assuring an effective cleaning result.

It will be appreciated by those skilled in the art that the hydraulic systems, their components and controls are all well known commercially available units. Although the invention has been shown and/or described in connection with a specific operational embodiment, it will be readily apparent to those skilled in the art that various changes in parameters can be made to suit requirements without departing from the spirit and scope of the invention and that the invention can be employed to effect a treatment of a surface other than that of a cleaning operation. For example, the number of pivots and their associated connecting members may be less than described and the number of brush units may consist of only a single unit having more or less than the number of brushes shown. Also, it will be appreciated that while the invention has been illustrated and described in connection with a vehicle highway tunnel, the invention can be utilized for cleaning other tunnels, such as railway and subway tunnels, in which the cleaning vehicle may conveniently travel over the rails of the tunnels.

I claim:

1. A mobile tunnel surface cleaning apparatus in combination with a roadway traveling vehicle having a support platform, said apparatus comprising:

an elongated boom means having inner and outer ends, said boom means supported at said inner end by the support platform in a manner permitting said boom means to be articulated relative to the roadway, power means operatively connected to said boom means for effecting said articulation thereof, brush assembly means carried by the outer and of said boom means, a first pivot means having first and second supporting means and having its axis arranged to effect movement in a first direction, said first supporting means carried by the outer end of said boom means, a second pivot means connected to said first pivot means and having its axis arranged to effect movement in a second direction substantially different from said first direction and carried by said second support means, said brush assembly means mounted on said second pivot means, separate power means for said first and second pivot means for articulating said brush assembly means about said associated axis of rotation of said first and second pivot means, said brush assembly means for comprising a plurality of brush units having individual brushes arranged on a common circle and having their free ends facing in a direction of the surface to be cleaned, means including a central support means for each brush unit comprising said brush assembly means for rotating said brushes, spoke support means connecting each of said brushes of a unit to a different one of said central support means outward of a said associated central support means, and means interposed between said spoke support means and said central support means in a manner to support said spoke support means while permitting said brush units to deflect when experiencing uneven pressure from a surface to be cleaned.

2. A cleaning apparatus according to claim 1, wherein said means to support said spoke means includes flexible means and third pivot means.

3. A cleaning apparatus according to claim 1, wherein, said spoke support mean having inner and outer ends, said inner ends connected to a different one of said central support means and said outer ends connected to a different one of said brushes outward of a said associated central support means, said spoke support means having base means at their said outer ends for carrying a different one of said brushes, said base means being formed with means for placing certain brushes in extended operative positions and others in recessed inoperative positions with reference to a surface to be cleaned.

4. A cleaning apparatus according to claim 1, wherein said separate power means includes means for establishing and maintaining desired articulated positions of said first and second pivot means, and wherein said power means includes means for both establishing a desired articulated position and for urging said boom means with a positive pressure in the direction of the surface to be cleaned.

5. A cleaning apparatus according to claim 1, wherein said brush assembly means comprises two in-line frames, each frame supporting at least one said brush unit, and wherein a separate said means for rotating said brush units is provided for the brush unit of each frame.

6. A cleaning apparatus according to claim 5, wherein said second pivot means includes separate support means for said frames, said separate support means for said frames each including pivotal means for permitting said frames to rotate in a common plane to desired articulated positions, and wherein said separate said means for rotating said brush units include means for reversing the direction of rotation of said brushes.

7. A cleaning apparatus according to claim 6, wherein said pivotal means for permitting said frames to rotate have ends extending away from said frames that carry means for providing cleaning liquid to the surface to be cleaned in the vicinity of said brushes, said means for providing cleaning liquid comprising at least one spray header means, and wherein said spray header means have internal passageways for delivering cleaning liquid to said spray header means.

8. A cleaning apparatus according to claim 6, including adjustable turnbuckle means pivotally connected to the inner adjacent ends of said frames for effecting said rotation thereof.

9. A mobile tunnel surface cleaning apparatus in combination with a roadway traveling vehicle having a front cab end and a bed behind the cab, said apparatus comprising:

an elongated boom means having inner and outer ends, support means carried by the bed connected to said inner end of said boom means, and including means for permitting said boom means to be articulated in vertical and transverse directions relative to the roadway, power means operatively connected to said boom means for effecting said articulation thereof, brush assembly means carried by the outer end of said boom means and including a beam means, a first pivot means having its axis arranged generally perpendicular to the roadway and including a first means for carrying said beam means and a second means carried by said outer end of said boom, a second pivot means having its axis arranged generally parallel to the roadway, including a housing means carried by said beam means and being arranged to be displaced by movement about said first pivot means, a third pivot means carried by said housing means having its axis of rotation arranged generally coplanar to the longitudinal axis of said beam means, said third pivot means being arranged to be displaced by movement about said first and second pivot means and having a carrying means, separate power means for said first, second and third pivot means for articulating said brush assembly means about said associated axes of rotation of said first, second and third pivot means, said brush assembly means further comprising a plurality of brush units arranged on a common generally linear plane supported by said carrying means, each said brush units comprising a plurality of individual brushes arranged on a common circle and having their free ends facing in a direction of the surface to be cleaned, means for rotating said brush units, and means carried by said brush assembly means for providing cleaning liquid to the surface to be cleaned in the vicinity of said brushes.

10. A cleaning apparatus according to claim 9, wherein said bed includes means for carrying ancillary cleaning means, including liquids employed in the cleaning operation, said cab end including the power means for the vehicle, said bed and said means carried thereby representing a substantially greater weight than said cab end, and wherein said boom and beam means are arranged to place said brush assembly means in an operative cleaning position extending toward said front cab end of the vehicle, whereby the weight of the said bed and said means carried thereby allow the brush assembly to apply a substantially high brush pressure to the surface to be cleaned without making it difficult to keep the vehicle traveling on the roadway in a desired path of travel.

11. A cleaning apparatus according to claim 9, wherein said carrying means includes a member fixed to said housing having a fourth pivot arranged perpendicularly to said third pivot and an adjustable member connected to said brush units constructed to move relative to said fixed member about said fourth pivot.

12. A mobile tunnel surface cleaning apparatus in combination with a roadway traveling vehicle having a front cab and bed behind the cab, said apparatus comprising;

an elongated boom means supportable at its inner end by the bed in a manner to be positionable in an inoperative position extending in the direction of and overlying the bed of the vehicle and an operative position extending towards and in the direction of the cab of the vehicle, support means connected to said boom means carried by the bed, including means for permitting said boom means to be articulated in vertical and transverse directions relative to the roadway and lengthen and shorten relative to said support means, power means operatively connected to said boom means for effecting said articulation and lengthening and shortening thereof, brush assembly means carried by the outer end of said boom means by interconnecting means, said interconnecting means comprising an elongated beam means and first, second and third pivot means, said first pivot means including a first part for carrying said beam means and a second part carried by the outer end of said boom means and having its axis arranged generally perpendicular to the roadway, said second pivot means having its axis arranged generally parallel to the roadway, including a housing means carried by said beam means and being arranged to be displaced by movement said first pivot means, said third pivot means carried by said housing means having its axis of rotation arranged generally coplanar to the longitudinal axis of said beam means, said third pivot means being arranged to be displaced by movement about said first and second pivot means and having a carrying means, separate power means for said first, second and third pivot means for articulating said brush assembly means about said associated axes of rotation of said first, second and third pivot means, said brush assembly means comprising a plurality of brush units arranged on a common generally linear plane and carried by said carrying means of said third pivot means, each said brush units comprising a plurality of individual brushes arranged on a common circle and having their free ends facing in a direction of the surface to be cleaned, means for rotating said brush units, and means carried by said brush assembly means for providing cleaning liquid to the surface to be cleaned in the vicinity of said brushes.

13. An articulated brush assembly adapted to clean a surface comprising support means for said brush assembly, said support means having first pivot means having its axis arranged to effect movement in a first direction, and including means for permitting a part of said supporting means to be articulated in said direction, power means connected to said support means for effecting articulation thereof, a second pivot means supported by said part of said supporting means and having its axis arranged to effect movement in a second direction substantially different from said first direction, a third pivot means having its axis arranged to effect movement in a third direction substantially different from said first and second directions, and having a carrying means, separate power means for said first, second and third pivot means for articulating said brush assembly about said associated axes of rotation of said each pivot means, said brush assembly carried by said carrying means of said third pivot means, said brush assembly comprising a plurality of individual brushes arranged on a common circle and having their free ends facing in a direction of the surface to be cleaned, means comprising a central support for rotating said brushes, spoke support means including flexible means and fourth pivot means connecting each of said brushes to said central support means, and means carries by said central support means in a manner to support said spoke support means while permitting said brushes to deflect when experiencing uneven pressure from a surface to be cleaned.

14. An articulated brush assembly adapted to clean a surface comprising supporting means for said brush assembly, said supporting means having first pivot means having its axis arranged to effect movement in a first direction, and including means for permitting a part of said supporting means to be articulated in said direction, power means connected to said support means for effecting articulation thereof, a second pivot means supported by said part of said supporting means and having its axis arranged to effect movement in a second direction substantially different from said first direction, a third pivot means having its axis arranged to effect movement in a third direction substantially different from said first and second directions, and having a carrying means, separate power means for said first, second and third pivot means for articulating said brush assembly about said associated axes of rotation of said each pivot means, said brush assembly carried by said carrying means of said third pivot means, said brush assembly comprising a plurality of individual brushes arranged on a common circle and having their free ends facing in a direction of the surface to be cleaned, means comprising a central support for rotating said brushes, spoke support means having inner and outer ends, said inner ends connected to said central support means and said outer ends connected to said brushes outward of said central support means, said spoke support means having base means at their said outer ends for carrying said brushes, and said base means being formed with means for placing certain brushes in extended operative positions and others in recessed inoperative positions with reference to a surface to be cleaned.

15. An articulated brush assembly according to claim 14, wherein each said brushes are made up of alternately arranged first and second bristles, said first bristles having a degrees of stiffness substantially greater than the stiffness of said second bristles, and said second bristles having a density substantially greater than said first bristles, whereby said second bristles increase the abrasion cleaning action and retention of the cleaning agent and said first bristles provide stiffness for the second bristles against centrifugal force.

16. An articulated brush assembly according to claim 15, wherein said first and second bristles are formed to have a waviness in the direction of their lengths and have an oval cross-sectional shape.

17. An articulated brush assembly adapted to clean a surface comprising supporting means for said brush assembly, said supporting means having first pivot means, including means for permitting a part of said supporting means to be articulated in two different directions generally perpendicular to each other, power means connected to said supporting means for effecting said articulation thereof, said supporting means further comprising second, third and fourth pivot means, said second pivot means supported by said part of said supporting means having its axis arranged generally perpendicular to a reference plane, said third pivot means having its axis arranged generally parallel to said reference plane and having a housing means carried by a part of said second pivot means and being arranged to be displaced by movement about said first and second pivot means, said fourth pivot means carried by said housing means having its axis of rotation arranged generally in a different plane than planes containing the axis of said first, second and third pivots means, said fourth pivot means being arranged to be displaced by movement about said first, second and third pivot means, and having a carrying means, separate power means for each said pivot means for articulating said brush assembly about said associated axes of rotation of each said pivot means, said brush assembly comprising a plurality of brush units arranged on a common generally linear plane and carried by said carrying means of said fourth pivot means, each said brush units comprising a plurality of individual brushes arranged on a common circle and having their free ends facing in a direction of the surface to be cleaned, means for rotating said brush units, and means carried by said brush assembly for providing cleaning liquid to the surface to be cleaned in the vicinity of said brushes.

18. An articulated brush assembly adapted to clean a surface comprising supporting means for said brush assembly, said supporting means having first pivot means, including means for permitting a part of said supporting means to be articulated in two different directions generally perpendicular to each other, power means connected to said supporting means for effecting said articulation thereof, said supporting means further comprising an elongated beam means and second, third and fourth pivot means, said second pivot means supported by said part of said supporting means, including carrying means for supporting said beam means and having its axis arranged generally perpendicular to a reference plane, said third pivot means having its axis arranged generally parallel to said reference plane and having a housing means carried by said beam means and being arranged to be displaced by movement about said first and second pivot means, said fourth pivot means carried by said housing means having its axis of rotation arranged generally co-planar to the longitudinal axis of said beam means, said fourth pivot means being arranged to be displaced by movement about said first, second and third pivot means and having a carrying means, separate power means for each said pivot means for articulating said brush assembly about said associated axes of rotation of each said pivot means, said brush assembly comprising a plurality of brush units arranged on a common generally linear plane and carried by said carrying means of said fourth pivot means, each said brush units comprising a plurality of individual brushes arranged on a common circle and having their free ends facing in a direction of the surface to be cleaned, means for rotating said brush units.

19. A mobile tunnel surface cleaning apparatus in combination with a roadway traveling vehicle having a support platform, said apparatus comprising;

an elongated boom means having inner and outer ends, said boom means supported at said inner end by the support platform in a manner permitting said boom means to be articulated relative to the roadway, power means operatively connected to said boom means for effecting said articulation thereof, brush assembly means carried by the outer end of said boom means, a first pivot means having first and second supporting means and having an axis arranged to effect movement in a first direction, said first supporting means carried by the outer end of said boom means, a second pivot means connected to said first pivot means and having its axis arranged to effect movement in a first direction, said first supporting means carried by the outer end of said boom means, a second pivot means connected to said first pivot means and having its axis arranged to effect movement in a second direction substantially different from said first direction and carried by said second supporting means, said brush assembly means mounted on said second pivot means, separate power means for said first and second pivot means for articulating said brush assembly means about said associated axis of rotation of said first and second pivot means, said brush assembly means comprising a plurality of brush assemblies each with a central pivot support and a flexible drive members drivenly connected to individual brushes spaced apart about arranged on a common circle to allow deflection of a brush while supported by the pivot when the brush in the circle experiences uneven pressure at and having their free ends facing in a direction of the surface to be cleaned, and means for rotating said brushes.

* * * * *